US011781820B2

(12) United States Patent
Nielsen et al.

(10) Patent No.: US 11,781,820 B2
(45) Date of Patent: Oct. 10, 2023

(54) HEAT EXCHANGER PLATE

(71) Applicant: Danfoss A/S, Nordborg (DK)

(72) Inventors: Helge Nielsen, Sydals (DK); Kent Julius, Nordborg (DK); Ulrik Holm, Nordborg (DK); Ivan Knudsen, Bjerringbro (DK); Jes Petersen, Kolding (DK)

(73) Assignee: Danfoss A/S, Nordborg (DK)

( * ) Notice: Subject to any disclaimer, the term of this patent is extended or adjusted under 35 U.S.C. 154(b) by 63 days.

(21) Appl. No.: 17/078,279

(22) Filed: Oct. 23, 2020

(65) Prior Publication Data

US 2021/0131750 A1 May 6, 2021

(30) Foreign Application Priority Data

Oct. 31, 2019 (DK) ..... PA201901278

(51) Int. Cl.

| | |
|---|---|
| ***F28F 3/10*** | (2006.01) |
| ***F28F 3/04*** | (2006.01) |
| ***F28F 3/08*** | (2006.01) |
| ***F28D 9/00*** | (2006.01) |

(52) U.S. Cl.

CPC ..... *F28F 3/10* (2013.01); *F28F 3/046* (2013.01); *F28F 3/083* (2013.01); *F28D 9/005* (2013.01); *F28F 2275/085* (2013.01)

(58) Field of Classification Search

CPC ..... F28F 3/10; F28F 3/08; F28F 3/083; F28F 3/046; F28F 2280/04; F28F 2230/00

See application file for complete search history.

(56) References Cited

U.S. PATENT DOCUMENTS

| | | | | |
|---|---|---|---|---|
| 4,377,204 | A * | 3/1983 | Johansson | F28F 3/10 165/166 |
| 4,635,715 | A * | 1/1987 | Andersson | F28F 3/10 403/375 |
| 4,905,758 | A | 3/1990 | Mathur et al. | |
| 4,995,455 | A * | 2/1991 | Mathur | F28F 3/10 165/166 |
| 5,070,939 | A * | 12/1991 | Mathur | F28F 3/10 165/166 |

(Continued)

FOREIGN PATENT DOCUMENTS

| | | | |
|---|---|---|---|
| CN | 1187615 | A | 7/1998 |
| CN | 1355879 | A | 6/2002 |

(Continued)

*Primary Examiner* — Jianying C Atkisson
*Assistant Examiner* — For K Ling
(74) *Attorney, Agent, or Firm* — McCormick, Paulding & Huber PLLC

(57) ABSTRACT

A heat exchanger plate (2) is described comprising an edge (7), a groove (8) running along the edge (7), a gasket arranged in the groove (8), and a corrugated area (10) having tops (12) and valleys (11) between the groove (8) and the edge (7), wherein tops (12) run substantially perpendicular to the edge (7). In such a heat exchanger plate the gasket should be reliably fixed without affecting the stability of the heat exchanger. To this end, in at least one valley (11) a raised section (14) extends from a bottom area (13) of the valley (11) and the gasket comprises a click-on extension arranged in the valley (11) and having a recess adapted to the raised section (14).

14 Claims, 3 Drawing Sheets

(56) References Cited

U.S. PATENT DOCUMENTS

| | | | | | |
|---|---|---|---|---|---|
| 5,178,212 | A * | 1/1993 | Nakamura | F28F 3/10 | 165/166 |
| 5,727,620 | A * | 3/1998 | Schaufele | F28F 3/10 | 165/166 |
| 5,887,650 | A * | 3/1999 | Yang | F28F 3/10 | 165/166 |
| 5,988,268 | A * | 11/1999 | Usami | F28F 3/10 | 165/166 |
| 6,070,658 | A * | 6/2000 | Cipriani | F28F 3/10 | 165/DIG. 365 |
| 6,513,584 | B2 * | 2/2003 | Lehmann | F28F 3/10 | 165/166 |
| 6,935,415 | B1 * | 8/2005 | Petersen | F28F 3/10 | 165/166 |
| 10,451,361 | B2 * | 10/2019 | Rasmussen | F28F 3/10 | |
| 10,663,235 | B2 * | 5/2020 | Petersen | F28F 3/10 | |
| 2002/0074112 | A1 * | 6/2002 | Lehmann | F28F 3/10 | 165/166 |

FOREIGN PATENT DOCUMENTS

| | | | | |
|---|---|---|---|---|
| CN | 205482513 | U | 8/2016 | |
| CN | 109141095 | A | 1/2019 | |
| EP | 0 450 188 | A1 | 10/1991 | |
| EP | 2775248 | A1 * | 9/2014 | B28B 1/008 |
| EP | 2361365 | B1 | 10/2015 | |
| RU | 2 246 673 | C2 | 2/2005 | |
| RU | 2 555 087 | C1 | 7/2015 | |

* cited by examiner

HEAT EXCHANGER PLATE

CROSS-REFERENCE TO RELATED APPLICATION

This application claims foreign priority benefits under 35 U.S.C. § 119 to Danish Patent Application No. PA201901278 filed on Oct. 31, 2019, the content of which is hereby incorporated by reference in its entirety.

TECHNICAL FIELD

The present invention relates to a heat exchanger plate comprising an edge, a groove running along the edge, a gasket arranged in the groove, and a corrugated area having tops and valleys between the groove and the edge, wherein tops run substantially perpendicular to the edge.

BACKGROUND

Such a heat exchanger plate is known, for example, from EP 2 361 365 B1.

The heat exchanger plate is used for a plate-type heat exchanger. To produce such a plate-type heat exchanger, the heat exchanger plates are stacked together and arranged between two end plates. In this way, two flow paths are formed so that two fluids can circulate in order to change heat between them.

Before stacking the plates, the gasket must be placed and fixed in the groove. To this end, in the known heat exchanger plate a click-on tap is used which is pressed from the side of the edge onto the corrugated area and holds the gasket in the groove. However, such a way of fixing the gasket in the groove requires an additional element and an additional mounting step.

A further heat exchanger plate of a plate-type heat exchanger is known, for example, from U.S. Pat. No. 5,178,212 A. Here, the gasket comprises a fixing piece which is arranged in a recess in a part between the edge and the groove. However, here it is not possible to use a corrugated area. The corrugated area increases the possibility of the heat exchanger to withstand high pressures.

SUMMARY

The object underlying the invention is to provide a heat exchanger plate in which the gasket can reliably be fixed without affecting the stability of the heat exchanger.

This object is solved with a heat exchanger plate as described at the outset in that in at least one valley a raised section extends from a bottom area of the valley and the gasket comprises a click-on extension arranged in the valley and having a recess adapted to the raised section.

When such a heat exchanger plate is used to assemble a plate-type heat exchanger, the gasket is equipped at least with one click-on extension, however, preferably with a number of click-on extensions adapted to the number of raised sections in the valleys. The click-on extension of the gasket is then pressed into the valley. During this step the raised section enters the recess of the click-on extension so that the gasket is fixed to the heat exchanger plate. Apart from the raised section in the bottom area of the valley no further modifications of the heat exchanger plate are necessary, so that a heat exchanger plate can be used which has been proven to be reliable and to withstand the desired pressures. The corrugated area can still be used to increase the stability of the edge section of the heat exchanger plate.

In some cases, the corrugated area can be used as a connection area between two adjacent heat exchanger plates.

In an embodiment of the invention at least one inner projection is provided in the recess of the click-on extension of the gasket, the raised section forms a hollow, and the at least one inner projection projects into the hollow. When the click-on extension of the gasket is pressed into the valley of the corrugated area and the raised section enters the recess, the inner projection snaps into the hollow formed by the raised section. This increases the holding forces holding the gasket at the heat exchanger plate.

In an embodiment of the invention two inner projections are provided in the recess, the projections pointing in opposite directions. Thus, the raised section is embraced from two sides which gives an enhanced stability and holds a gasket reliably at the heat exchanger plate.

In an embodiment of the invention the click-on extension fully fills out the valley. Thus, there is no possibility of a lateral movement of the click-on extension in a direction parallel to the edge. The risk is reduced that the click-on extension comes free from the raised section of the valley.

In an embodiment of the invention the raised section is formed by a cut-out of the bottom area. This is a simple way to produce the raised sections. Only a cutting step and a stamping step are necessary to produce the raised section.

In an embodiment of the invention the raised section is connected at two ends to the bottom area. In this case, two cuts are necessary which run basically in parallel. The strip remaining between the two cuts is bent out of the bottom area. In this way, the hollow is automatically formed.

In an embodiment of the invention the two ends are arranged on a line perpendicular to the edge. Thus, the two cuts run substantially perpendicular to the edge.

In an embodiment of the invention the raised comprises an upper wall having a width in a direction parallel to the edge which is smaller than the corresponding width of a hole in the bottom area of the valley. The hole in the bottom area of the valley is formed by bending out the upper wall of the raised section after the cutting step. When the width of the upper wall is smaller than the corresponding width of the hole in the bottom area, it is easier to remove the heat exchanger plate from the manufacturing tool.

In an embodiment of the invention the upper wall is curved. The curved form can be convex or concave. The curve form can be produced during the stamping process. When the upper wall is curved, the width of the upper wall is decreased.

In an embodiment of the invention the upper wall comprises a bend. In other words, the upper wall is bent to comprise, for example, an obtuse angle. The bend can likewise be produced during the stamping process. When the upper wall is bent, the width of the upper wall is decreased.

BRIEF DESCRIPTION OF THE DRAWINGS

The invention will now be described in more detail with reference to the drawing, wherein.

DETAILED DESCRIPTION

Figure 3:
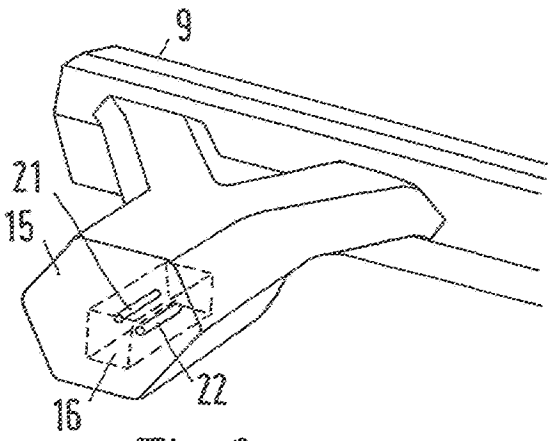
FIG. 3 shows a detail of a gasket.

In all Figures the same elements are denoted with the same reference numerals.

Figure 1:
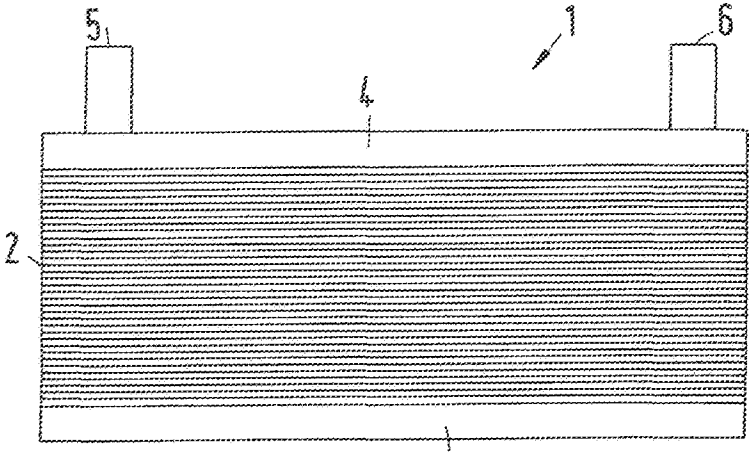
FIG. 1 shows a side view of a plate-type heat exchanger.

FIG. 1 schematically shows a heat exchanger 1 comprising a stack of heat exchanger plates 2 which are arranged between a first end plate 3 and a second end plate 4. Four ports (two ports 5, 6 are shown only) are used to establish a first flow path and a second flow path through the heat exchanger 1. The two flow paths are separated from each other by means of the heat exchanger plates 2.

Figure 2:
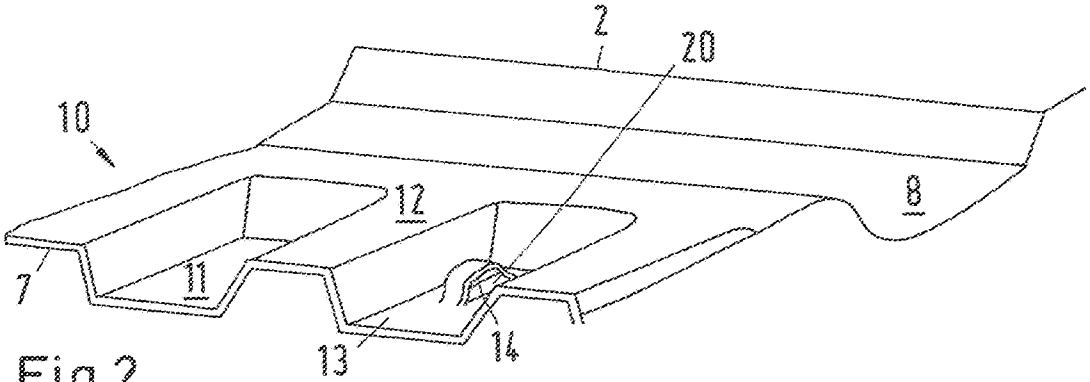
FIG. 2 shows a detail of a heat exchanger plate.

FIG. 2 shows a detail of a heat exchanger plate 2. The heat exchanger plate 2 comprises an edge 7, a groove 8 running along the edge 7, a gasket 9 (FIG. 3) which is shown separated from the heat exchanger plate 2, but in use arranged in the groove 8, and a corrugated area 10 having valleys 11 and tops 12 between the groove 8 and the edge 7.

Each valley 11 comprises a bottom area 13. In at least one valley 11 a raised section 14 extends from the bottom area 13 of the valley 11 and the gasket 9 comprises a click-on extension 15 which is arranged in the valley 11 comprising the raised section 14. The click-on extension 15 comprises a recess 16. The recess 16 takes up the raised section 14, when the click-on extension 15 is arranged in the valley 11 having the raised section 14.

When the gasket 9 is mounted in the groove 8, the click-on extension 15 fully fills out the valley 11.

The raised section 14 is formed by cutting the bottom area 13 at two lines 17, 18 (FIGS. 5 and 6) and by bending a part of the bottom area 13 between the two cutting lines 17, 18 out of the bottom area 13 to form an upper wall 19. The cutting lines 17, 18 extend substantially perpendicular to the edge 7. In this way, the two ends of the raised section are arranged on a line perpendicular to the edge 7.

In this way a hollow 20 is formed by the raised section which is arranged below the upper wall 19.

The click-on extension 15 comprises two projections 21, 22 which are provided in the recess 16. The projections 21, 22 point in opposite direction, in particular substantially parallel to the edge 7. When the gasket 9 is placed in the groove 8 and the click-on extension 15 is placed in the valley 11 comprising the raised section 14, the two projections 21, 22 project into the hollow 20. Since the gasket 9 is made from an elastic material, the click-on extension 15 can be snapped onto the raised section 14, so that the click-on extension 15 is held in the valley 11 by positive locking.

Figure 4:
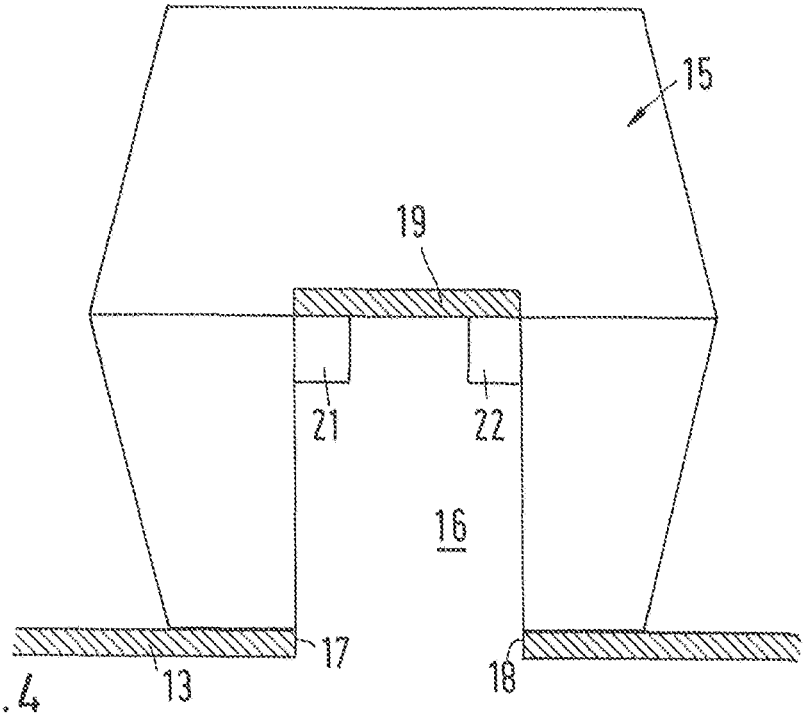
FIG. 4 shows a schematic illustration of a gasket in a valley.

This is schematically shown in FIG. 4. The gasket 5 shows the recess 16 and the two projections 21, 22 extend or project inwardly into the recess 16, so that they can snap under the upper wall 19 formed by a raised section 14.

Figure 5A:
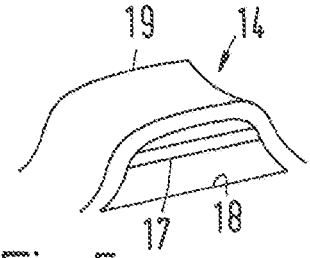
FIG. 5*a* shows perspective view of a first embodiment of a raised section.
Figure 5B:
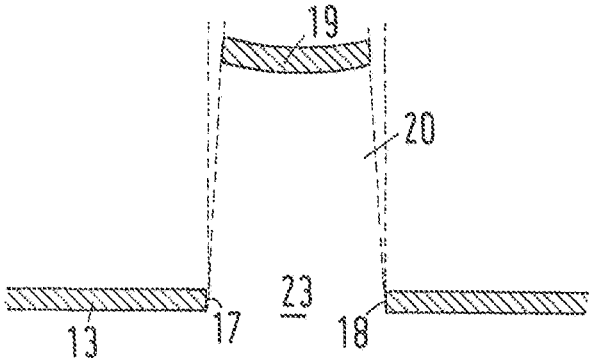
FIG. 5*b* shows cross-sectional view of FIG. 5*a*.
Figure 6A:
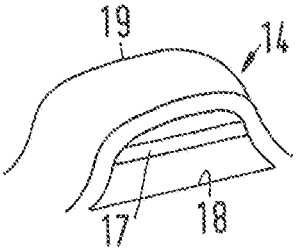
FIG. 6*a* shows perspective view of a second embodiment of a raised section.
Figure 6B:
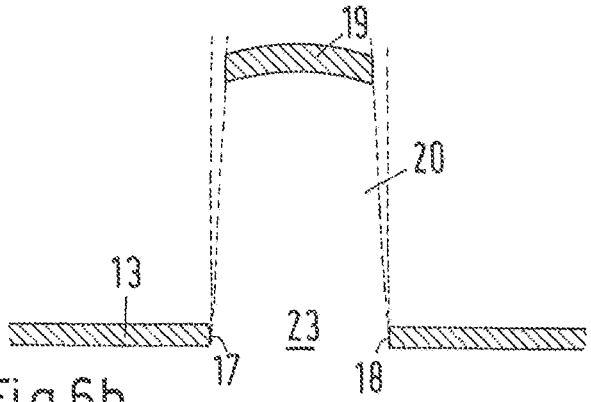
FIG. 6*b* shows cross-sectional view of FIG. 6*a*.

As it is shown in FIGS. 5 and 6, the upper wall 19 has a width in a direction parallel to the edge 7 which is smaller than a corresponding width of a hole 23 in the bottom area 13 of the valley 11. The hole 23 is formed between the two cutting lines 17, 18 and by bending or stamping the upper wall 19 out of the bottom area 13.

The width of the upper wall 19 is reduced by forming the upper wall 19 into a curved shape.

FIG. 5 shows a first embodiment of the raised area 14, in which the upper wall 19 has a concave shape. FIG. 6 shows an alternative embodiment, in which the upper wall 19 has a concave shape.

Both curved shapes of the upper wall 19 can be produced during the stamping process, in which the upper wall 19 is bent out of the bottom area 13. When the width of the upper wall 19 is smaller than the width of the hole 23 between the two cutting lines 17, 18, it is easier to remove the heat exchanger plate 2 from the corresponding tool.

Figure 7:
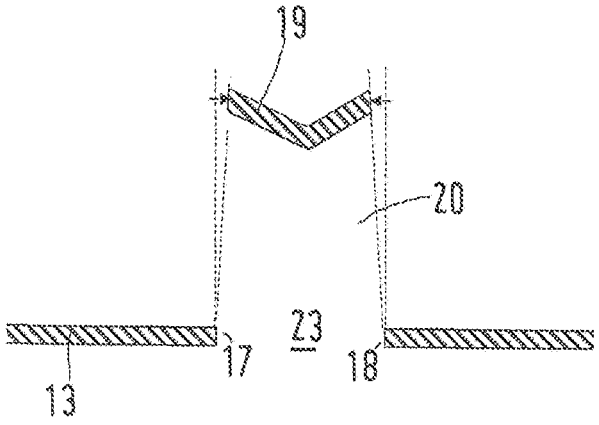
FIG. 7 shows a third embodiment of a raised section.
Figure 8:
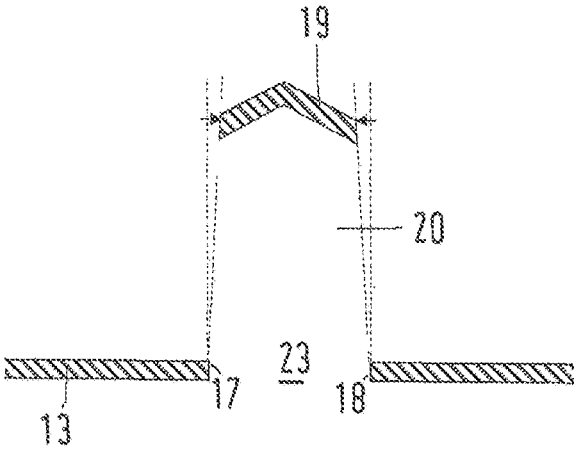
FIG. 8 shows a fourth embodiment of a raised section.

FIGS. 7 and 8 show further embodiments of the raised area.

In FIG. 7 the upper wall 19 is bent to form an obtuse angle opening to the top. Bending of the upper wall 19 reduces the width of the upper wall in relation to the width of the hole 23.

FIG. 8 shows an alternative embodiment in which the upper wall 19 forms likewise an obtuse angle, however the angle opening to the bottom.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A heat exchanger plate comprising an edge, a groove running along the edge, a gasket arranged in the groove, and a corrugated area having tops and valleys between the groove and the edge, wherein tops run perpendicular to the edge, wherein a raised section in at least one of the valleys extends from a bottom area of the valley and the gasket comprises a click-on extension arranged in the valley and having a recess configured to click onto the raised section, wherein at least one inner projection is provided in the recess of the click-on extension of the gasket, the raised section forms a hollow, and the at least one inner projection projects into the hollow, wherein the valley is adjacent to and separate from the groove such that the floor of the valley is not a continuous extension of the floor of the groove.

2. The heat exchanger plate according to claim 1, wherein two inner projections are provided in the recess, the projections pointing in opposite directions.

3. The heat exchanger plate according to claim 1, wherein the click-on extension fully fills out the valley.

4. The heat exchanger plate according to claim 1, wherein the raised section is formed by a cut-out of the bottom area.

5. The heat exchanger plate according to claim 4, wherein the raised section is connected at two ends to the bottom area.

6. The heat exchanger plate according to claim 5, wherein the two ends are arranged on a line perpendicular to the edge.

7. The heat exchanger plate according to claim 4, wherein the raised section comprises an upper wall having a width in a direction parallel to the edge which is smaller than a corresponding width of a hole in the bottom area of the valley.

8. The heat exchanger plate according to claim 7, wherein the upper wall is curved.

9. The heat exchanger plate according to claim 7, wherein the upper wall comprises a bend.

10. The heat exchanger plate according to claim 2, wherein the click-on extension fully fills out the valley.

11. The heat exchanger plate according to claim 2, wherein the raised section is formed by a cut-out of the bottom area.

12. The heat exchanger plate according to claim 3, wherein the raised section is formed by a cut-out of the bottom area.

13. The heat exchanger plate according to claim 5, wherein the raised section comprises an upper wall having a width in a direction parallel to the edge which is smaller than a corresponding width of a hole in the bottom area of the valley.

14. The heat exchanger plate according to claim 6, wherein the raised section comprises an upper wall having a width in a direction parallel to the edge which is smaller than a corresponding width of a hole in the bottom area of the valley.

* * * * *